United States Patent [19]

Weston

[11] 4,085,231

[45] Apr. 18, 1978

[54] CONTAINER EVACUATION PROCESS

[75] Inventor: Joseph F. R. Weston, Peabody, Mass.

[73] Assignee: W. R. Grace & Co., Duncan, S.C.

[21] Appl. No.: 731,065

[22] Filed: Oct. 8, 1976

[51] Int. Cl.[2] ..... B65B 31/04

[52] U.S. Cl. ..... 426/410; 53/22 B; 141/7; 141/65

[58] Field of Search ..... 426/410; 53/22 B, 112 B, 53/79, 22 R, 112 R; 141/65, 66, 7, 46, 114; 261/78 A

[56] References Cited

U.S. PATENT DOCUMENTS

| | | | |
|---|---|---|---|
| 2,284,551 | 5/1942 | Alexander | 53/22 R X |
| 2,657,846 | 11/1953 | Schmalz | 141/65 |
| 2,913,232 | 11/1959 | Silverman | 261/78 A X |
| 3,463,342 | 8/1969 | Bender et al. | 53/112 R |
| 3,693,314 | 9/1972 | Reid et al. | 53/22 B |
| 3,699,742 | 10/1972 | Giraudi | 523/112 B X |
| 3,759,722 | 9/1973 | Simon | 53/22 B |
| 3,809,080 | 5/1974 | Deaton | 261/78 A X |
| 3,832,824 | 9/1974 | Burrell | 53/22 B |
| 3,851,437 | 12/1974 | Waldrop | 53/22 B |
| 3,903,884 | 9/1975 | Huston | 261/DIG. 65 X |

FOREIGN PATENT DOCUMENTS

| | | | |
|---|---|---|---|
| 2,219,880 | 10/1973 | Germany. | |
| 471,057 | 5/1952 | Italy | 426/410 |
| 210,521 | 2/1924 | United Kingdom | 261/62 |
| 19,164 of | 1906 | United Kingdom | 261/62 |

*Primary Examiner*—Steven L. Weinstein

*Attorney, Agent, or Firm*—John J. Toney; William D. Lee, Jr.; John B. Hardaway

[57] ABSTRACT

Air or other fluid is removed from a container by placing the mouth of the container inside a nozzle and having air or other fluid flow between the mouth of the container and the nozzle so as to extract the air of fluid from the container.

10 Claims, 1 Drawing Figure

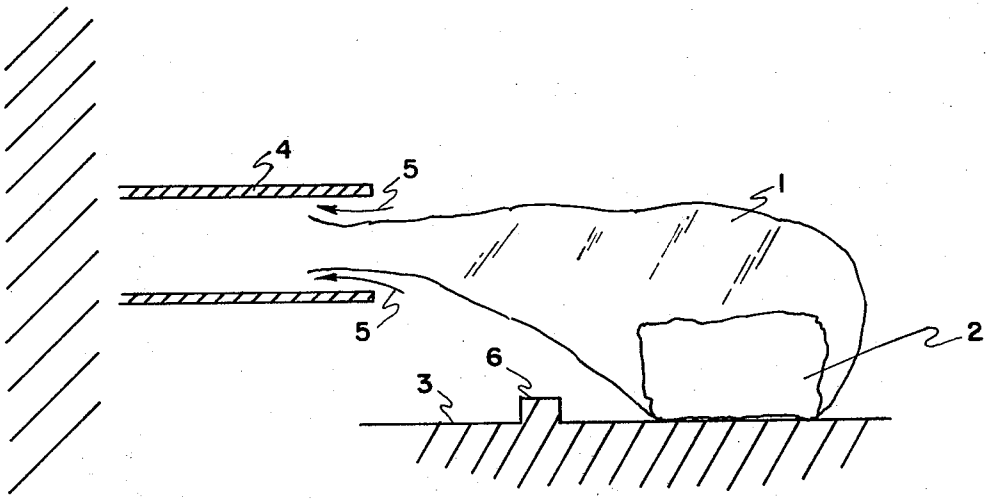
4
5
1
5
2
6
3

CONTAINER EVACUATION PROCESS

BACKGROUND OF THE INVENTION

The present invention relates generally to a process for removing air or fluid from a container. It relates, more particularly, to a process for removing air from a flexible plastic container having fresh meat enclosed therein.

In the packaging of food products such as fresh meat, it is conventional to maintain the container under a greatly reduced pressure in order to prevent oxidation and spoilage of the meat articles. The maintenance of meat articles in a substantially oxygen free environment not only prevents spoilage but maintains the meat articles in a substantially fresh state for considerably longer periods of time than is possible in an oxygen containing environment.

Conventionally food packages have been evacuated after placing the meat article within the container by placing the opened neck of the container around the exterior of a nozzle and extracting the atmosphere within the container through the nozzle. The state of reduced pressure is maintained within the container by clipping or otherwise closing the mouth of the container so as to make the entrance of air or deleterious substances highly unlikely. A problem associated with the prior art technique is the presence of a vacuum within the container which tends to collapse the neck of the container thus restricting the flow of remaining air from the container. Another problem of the prior art process is the entrapment of air at the back of the container due to the presence of irregularly shaped products within the container.

SUMMARY OF THE INVENTION

It is thus an object of this invention to provide a novel process for evacuating air and other fluids from a container.

It is a further and more particular object of this invention to provide a process for evacuating air from flexible plastic packages containing meat products.

It is a still further object of this invention to provide a process for evacuating meat packages wherein the collapse of container necks and entrapment of air behind irregularly shaped objects is no longer a problem.

These, as well as other objects, are accomplished by a process for pressure reduction within a rigid or a flexible container which is particularly applicable to flexible plastic containers charged with food. The process comprises inserting the neck and open end of a container into the mouth of a nozzle and forcing air or other fluid to flow between the neck of the container and the nozzle. The container is evacuated due to the high velocity flow between the neck of the container and the nozzle. The merchandise within the container is thus left under a reduced pressure. The neck of the container can then be sealed by conventional techniques to permanently prevent the infusion of deleterious substances into the container. The process of sealing the container neck may be carried out within the nozzle or subsequently at a separate station.

BRIEF DESCRIPTION OF THE DRAWING

The single FIGURE of drawing is an illustration of a container being evacuated by the process of this invention.

DETAILED DESCRIPTION OF THE DRAWING

According to this invention it has been found that a container may be evacuated rapidly and effectively by disposing the neck of the container within a nozzle and forcing high velocity air to flow between the nozzle and the neck of the container. While the description given herein is with particular reference to evacuating air from a flexible container having fresh meat packaged therein, it will be understood that the process of this invention can be utilized to evacuate any fluid from any type of container. It should be further understood that the use of this description with reference to air is for illustrative purposes only in that this invention encompasses broadly the evacuation of any fluid from any type of container.

The process of this invention may be better understood by referring to the single FIGURE of drawing. As is illustrated thereon a container 1 having a meat product 2 therein is stationed on a surface 3 adjacent to nozzle 4. The flow of high velocity air through the nozzle between the mouth of the nozzle and the neck of the container is illustrated by means of arrows 5. The flow of air is preferably created by a vacuum pump communicating with nozzle 4 so as to create the flow of air 5. However, the flow of high velocity air could equally well be created by a blower stationed on the exterior of the nozzle causing a flow of air around the flexible container and into the nozzle.

A particular advantage of the process of this invention is that the neck of a flexible container need not be physically disposed within the nozzle but can be disposed by the suction from the nozzle. It has been found to be advantageous to use a nozzle which is capable of being slowly closed around the neck of the container. A rubber nozzle is suitable for this purpose. A tapered nozzle, however, may also be used for this purpose. By slowly closing the nozzle, the area between the mouth of the nozzle and the neck of the container is slowly reduced until the point of contact is reached. By reducing the area, the velocity of air flowing between the nozzle and neck of the container is greatly increased, thus increasing the pressure reduction within the container.

During the evacuation process there is a tendency for the meat article 2 to move toward the nozzle and to plug the nozzle thus preventing further reduction and pressure within the container. For this reason it is advantageous to provide a means such as 6 for preventing the meat article from reaching the nozzle 4.

The velocity of the air flowing between the neck of the container and the mouth of the nozzle has been found to be not overly critical. When using flexible containers, the flow is preferably sufficient to produce a good cling of the container to the article. A satisfactory velocity for closing flexible containers has been found to be an initial velocity of about 4,000 feet per minute. This velocity, can of course, be increased by reducing the nozzle opening size. An initial velocity of about 4,000 feet per minute has been found to readily increase to over 6,000 feet per minute by manually squeezing a rubber nozzle attached to a 1 kilowatt conventional vacuum pump. A flexible container having a volume of about 1 gallon can be satisfactorily evacuated in 1 to 2 seconds with such an arrangement.

The state of reduced pressure within the container is permanently retained by sealing the neck of the container in a conventional manner. Any conventional sealing technique may be utilized once a state of reduced pressure is achieved within the container. The sealing technique may take the form of a twist and knot within the neck of the container. Preferably, however, when sealing fresh meat articles the neck of the container is clipped securely in a closed state by techniques well known in the art. A particular advantage of the process of this invention is that a clipping device can be provided within the nozzle so as to seal the container while the neck of the container is within the nozzle. Optionally any excess container material or salvage may be severed within the nozzle immediately after the stapling process. By severing the salvage at this point it is immediately carried away by the flow of air for disposal.

In another mode, the process of this invention can be carried out by using a single clipping device in conjunction with several vacuum nozzles. By operating in this manner each individual flexible container may be twisted or otherwise closed to temporarily retain the state of reduced pressure until it is transported to a clipping device to permanently preserve the state of reduced pressure.

From the above description it it thus seen that a novel process for evacuating containers has been provided. While the description has emphasized containers for packaging meat articles it is readily apparent that rigid containers for any type of article may be evacuated by the process of this invention. For example, garments may be packaged within either flexible or rigid containers for long term storage utilizing the process of this invention. The process of this invention thus provides a process wherein the problem of neck collapse and entrapment or air behind irregularly shaped objects is unexpectedly overcome. Many other applications and variations in the process of this invention will become apparent to those in the art upon a reading of the above description. Such variations, however, as are obvious are embodied within the spirit and scope of the appended claims.

What is claimed is:

1. A process for removing a gaseous fluid from a flexible container, said container having an article therein and being comprised of a body portion and a neck portion communicating with and defining a single opening in said container, said process comprising the steps of:

(a) placing the opening of said container within a nozzle, so as to leave a space between the neck of the said container and said nozzle, while substantially maintaining the portion of said container surrounding said article on the exterior of said nozzle; and (b) forcing fluid on the exterior of said container to flow from the exterior of said nozzle through said space and into said nozzle at a velocity sufficient to cause said gaseous fluid within said container to be withdrawn from said container through said opening and into said nozzle.

2. The process according to claim 1 wherein said gaseous fluid on the exterior of said container is air.

3. The process according to claim 2 wherein said step of forcing is carried out by exhausting said nozzle at a point remote from the container opening.

4. The process according to claim 2 wherein said step of forcing further comprises reducing said space by reducing the size of said nozzle whereby the velocity of air through said space is increased.

5. The process according to claim 2 wherein said container is a flexible container and said step of forcing is carried out with air at a velocity sufficient to cause said body portion to cling to said article within said container.

6. The process according to claim 2 wherein during said step of forcing the article within said container is prevented from moving toward said nozzle.

7. The process according to claim 2 wherein said container is a flexible plastic container.

8. The process according to claim 7 wherein said plastic container contains fresh meat.

9. The process according to claim 7 including the further step of clipping the neck portion of said container to prevent the ingress of fluid withdrawn by said step of forcing.

10. The process according to claim 9 wherein said step of clipping is carried out within said nozzle.

* * * * *